US009617851B2

(12) United States Patent
Dahl et al.

(10) Patent No.: US 9,617,851 B2
(45) Date of Patent: Apr. 11, 2017

(54) IN-SITU DOWNHOLE CUTTINGS ANALYSIS

(71) Applicant: Baker Hughes Incorporated, Houston, TX (US)

(72) Inventors: John Dahl, Spring, TX (US); Christopher J. Morgan, Spring, TX (US); Michael E. Gillen, The Woodlands, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 542 days.

(21) Appl. No.: 14/068,780

(22) Filed: Oct. 31, 2013

(65) Prior Publication Data

US 2015/0114714 A1 Apr. 30, 2015

(51) Int. Cl.
*E21B 49/00* (2006.01)

(52) U.S. Cl.
CPC ..... *E21B 49/005* (2013.01)

(58) Field of Classification Search
USPC ..... 175/40, 41, 45, 50
See application file for complete search history.

(56) References Cited

U.S. PATENT DOCUMENTS 5,495,174 A 2/1996 Rao et al.
6,206,108 B1 * 3/2001 MacDonald et al. ... E21B 44/00 175/24
2005/0096847 A1 5/2005 Huang
2005/0215893 A1 * 9/2005 Barnes ..... G01S 15/8925 600/437
2007/0112521 A1 * 5/2007 Akimov ..... G01V 11/00 702/6
2009/0199630 A1 8/2009 DiFoggio et al.
2009/0213690 A1 8/2009 Steinsiek et al.
2010/0044034 A1 * 2/2010 Bailey ..... E21B 47/12 166/253.1
2010/0101860 A1 4/2010 Wassermann et al.
2013/0030705 A1 1/2013 Pei et al.

FOREIGN PATENT DOCUMENTS

WO 96-21871 A1 7/1996
WO 2013089683 A1 6/2013

OTHER PUBLICATIONS

ISR in PCT/US2014/062585 dtd Feb. 13, 2015.
IPRP and Written Opinion in PCT/US2014/062585 dtd May 12, 2016.

* cited by examiner

*Primary Examiner* — Taras P Bemko
(74) *Attorney, Agent, or Firm* — Mossman Kumar & Tyler PC

(57) ABSTRACT

Systems, devices, and methods for evaluating cuttings entrained in a downhole fluid in a borehole intersecting an earth formation. Methods may include using at least one sensor to produce information responsive to a reflection of an emitted wave from downhole cuttings in the borehole, wherein the information is indicative of a parameter of interest relating to the downhole cuttings; and processing the information using at least one processor to estimate the parameter of interest. Methods may include using the at least one acoustic sensor to produce corresponding information from each of a plurality of azimuthally distributed orientations about a bottom hole assembly (BHA); and using the at least one processor to estimate from the information from each of the orientations an azimuthal variation of the parameter of interest. The at least one sensor may include acoustic sensors, electromagnetic sensors, and/or optical sensors.

19 Claims, 5 Drawing Sheets

IN-SITU DOWNHOLE CUTTINGS ANALYSIS

FIELD OF THE DISCLOSURE

In one aspect, this disclosure relates generally to analysis of downhole cuttings. More particularly, this disclosure relates to methods, devices, and systems for estimating a parameter of interest relating to downhole cuttings in near real-time.

BACKGROUND OF THE DISCLOSURE

Geologic formations are used for many purposes such as hydrocarbon production, geothermal production and carbon dioxide sequestration. Boreholes are typically drilled into the earth in order to intersect and access the formations. Drilling results in drill cuttings, which are small pieces of rock or other debris that break away from the formation due to the action of the drill bit. Cuttings are traditionally analyzed at the surface when they emerge from a discharge pipe due to circulation of the drilling mud. Often a distinct facility at the surface is outfitted to perform the analysis.

SUMMARY OF THE DISCLOSURE

In aspects, the present disclosure is related to methods of evaluating downhole cuttings entrained in a downhole fluid in a borehole intersecting an earth formation. Methods may include using at least one sensor to produce information responsive to a reflection of an emitted wave from downhole cuttings in the borehole; and processing the information using at least one processor to estimate the parameter of interest. The information may be indicative of a parameter of interest relating to the downhole cuttings. The wave and the reflection may be acoustic. Methods may also include using the parameter of interest to perform in near real-time at least one of: i) characterizing a drilling operation in the borehole; ii) optimizing one or more drilling parameters of a drilling operation in the borehole; and/or iii) optimizing a mud program circulating drilling fluid in the borehole. The parameter of interest may include at least one of: i) average particle size of the downhole cuttings; ii) distribution of particle sizes; iii) quantitative indicator of shape of the downhole cuttings; iv) volume of the downhole cuttings; and v) cuttings hold-up.

Using the at least one acoustic sensor to produce the information may include using the at least one acoustic sensor to produce corresponding information from each of a plurality of azimuthally distributed orientations about a bottom hole assembly (BHA). Processing the information may include using the at least one processor to estimate from the information from each of the orientations an azimuthal variation of the parameter of interest relating to the downhole cuttings.

Methods may further include producing the corresponding information from each of the plurality of azimuthally distributed orientations using each of a plurality of corresponding azimuthally distributed acoustic sensors; using a multi-directional acoustic sensor configured for beamforming to receive from each of the plurality of azimuthally distributed orientations the reflection of the corresponding emitted wave and produce the corresponding information; and/or using a transducer rotating about a substantially longitudinal axis of the BHA to receive at each of the plurality of azimuthally distributed orientations the reflection of the corresponding emitted wave and produce the corresponding information.

Some embodiments may include rotating the transducer with respect to the BHA. The method may further include defining a cross-section of the borehole as a plurality of sectors; and associating the corresponding information from each of the plurality of azimuthally distributed orientations with a corresponding azimuthal window representing at least one of the plurality of sectors. The estimated azimuthal variation may be used to perform in near real-time at least one of: i) characterizing a drilling operation; ii) optimizing one or more drilling parameters of a drilling operation; and/or iii) optimizing a mud program.

Methods may include using the at least one acoustic sensor to produce the corresponding information from each of a plurality of azimuthally distributed orientations at one or more first times; using the at least one acoustic sensor to produce later corresponding information from each of a plurality of azimuthally distributed orientations at one or more second times; and estimating from the corresponding information and the later corresponding information a change in azimuthal variation of the parameter of interest over time; and using the estimated change in azimuthal variation of the parameter of interest over time to perform in near real-time, with respect to the one or more second times, at least one of: i) characterizing a drilling operation; ii) optimizing one or more drilling parameters of a drilling operation; and/or iii) optimizing a mud program.

Methods may further include using the at least one acoustic sensor to produce the corresponding information from each of the plurality of azimuthally distributed orientations at one or more first times; using the at least one acoustic sensor to produce earlier corresponding information from each of the plurality of azimuthally distributed orientations at one or more third times; and estimating from the earlier corresponding information from each of the plurality of azimuthally distributed orientations a standoff of the bottom hole assembly from the borehole with respect to azimuth. For the corresponding information at the one or more first times the emitted acoustic wave may be at one or more first frequencies, and for the corresponding information at the one or more third times, the emitted wave may be at one or more second frequencies different than the one or more first frequencies. Some embodiments may include conveying the at least one acoustic sensor in the borehole on a conveyance device; and performing a drilling operation.

Embodiments according to the present disclosure may include apparatus for evaluating cuttings entrained in a downhole fluid in a borehole intersecting an earth formation. The apparatus may include a conveyance device; at least one acoustic sensor on the conveyance device, the at least one acoustic sensor configured to produce information responsive to a reflection of an emitted acoustic wave from downhole cuttings in the borehole, wherein the information is indicative of a parameter of interest relating to the downhole cuttings; and at least one processor configured to estimate the parameter of interest using the information. The at least one acoustic sensor may be configured to produce corresponding information from each of a plurality of azimuthally distributed orientations about the BHA. The at least one processor may be configured to estimate from the corresponding information from each of the orientations an azimuthal variation of the parameter of interest relating to the downhole cuttings.

The at least one acoustic sensor may include a plurality of azimuthally distributed acoustic sensors producing the corresponding information from each of the plurality of azimuthally distributed orientations.

Other apparatus embodiments may include an apparatus for evaluating cuttings entrained in a downhole fluid in a borehole intersecting an earth formation including a bottom hole assembly (BHA) configured for conveyance into the borehole; a plurality of sensors azimuthally distributed in the BHA, each of the sensors configured to produce information responsive to downhole cuttings in the borehole, wherein the information is indicative of a parameter of interest relating to the downhole cuttings; and at least one processor configured to estimate from the information from each of the sensors an azimuthal variation of the parameter of interest relating to the cuttings. The plurality of sensors may include a plurality of acoustic sensors. The plurality of sensors may include a plurality of electromagnetic sensors. The plurality of sensors may include a plurality of optical sensors.

Embodiments according to the present disclosure may include apparatus for evaluating cuttings entrained in a downhole fluid in a borehole, comprising: a processor; a non-transitory computer-readable medium; and a program stored by the non-transitory computer-readable medium comprising instructions that, when executed, cause the processor to perform a method as described herein.

Example features of the disclosure have been summarized rather broadly in order that the detailed description thereof that follows may be better understood and in order that the contributions they represent to the art may be appreciated.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION

Figure 1:
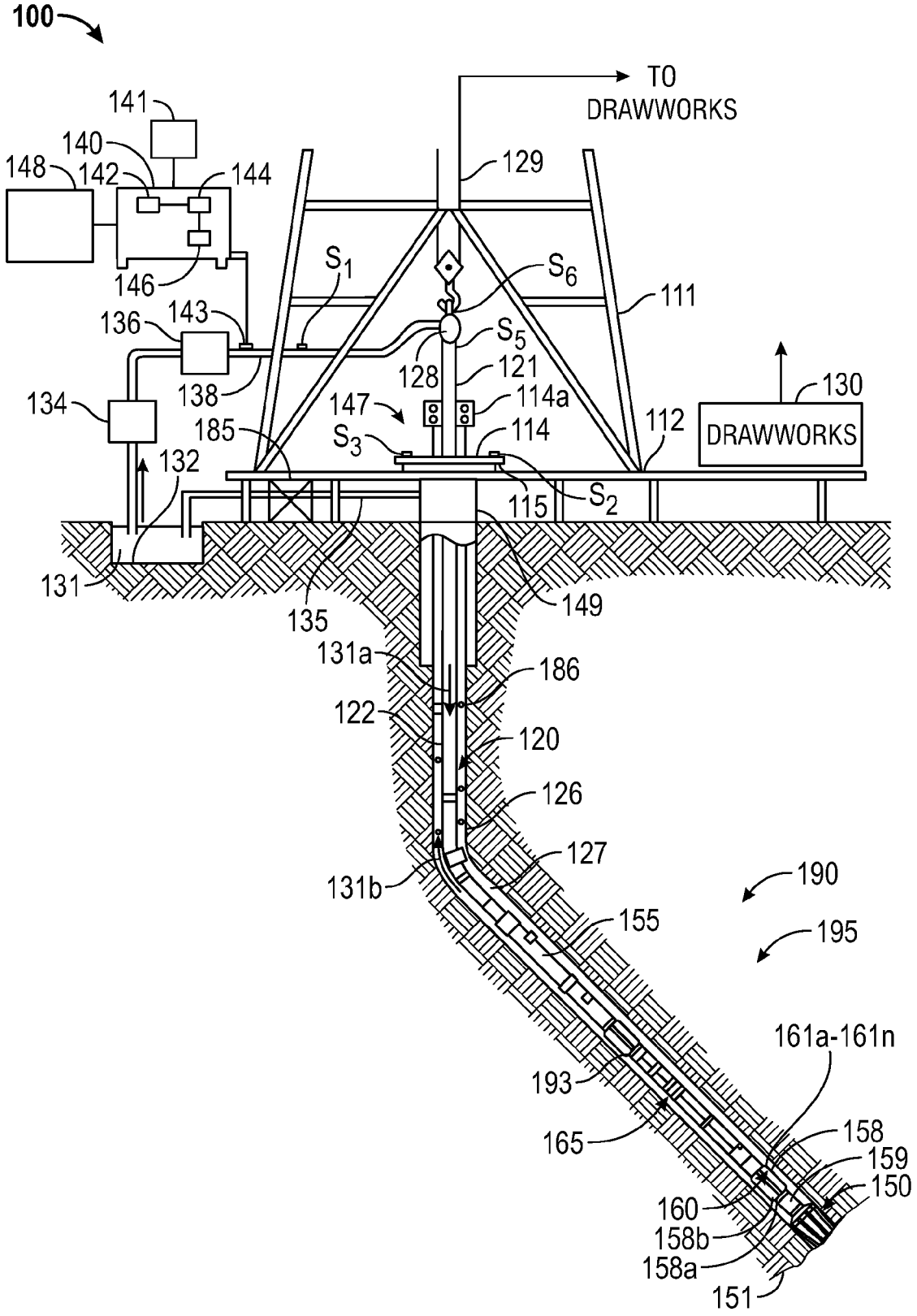
FIG. 1 is a schematic diagram of an exemplary drilling system according to embodiments of the disclosure.

Aspects of the present disclosure relate to evaluating downhole cuttings entrained in a downhole fluid in a borehole intersecting an earth formation. The downhole cuttings may be analyzed in-situ. That is, the downhole cuttings may be analyzed as they are produced, in near real-time.

During drilling, rotation of the drill bit disintegrates the formation at the distal end of the drill string, thereby producing drill cuttings. The characteristics of the cuttings produced at any one instant are indicative of the state of drilling at that time. In traditional cuttings analysis, samples of the cuttings are taken and analyzed at the surface when they emerge from a discharge pipe due to circulation of the drilling mud. A delay of over an hour (an possibly several hours) may occur between generation of the cuttings at the BHA and their arrival at the surface. This delay may limit the value of the information gained from the analysis, because, among other things, modification of drilling operations or the mud program is not timely with respect to the information extracted, determining the point in time (or the well depth, BHA orientation, etc.) with respect to events related to changes in the drill cuttings becomes problematic, and so on.

General embodiments of the present disclosure include methods, devices, and systems for evaluating downhole cuttings entrained in a downhole fluid in a borehole intersecting an earth formation. Evaluating the downhole cuttings may include using at least one acoustic sensor to produce information responsive to a reflection of an emitted acoustic wave from downhole cuttings in the borehole. The information is indicative of a parameter of interest relating to the downhole cuttings. The term "information" as used herein includes any form of information (analog, digital, EM, printed, etc.), and may include one or more of: raw data, processed data, and signals. Evaluating the downhole cuttings may include processing the information using at least one processor to estimate the parameter of interest. Example parameters of interest may include average particle size of the downhole cuttings; distribution of particle sizes; quantitative indicator of shape of the downhole cuttings; volume of the downhole cuttings; and cuttings hold-up. This information may be obtained in near real-time.

Methods disclosed herein may also include using the parameter of interest in performing further operations in the borehole (e.g., drilling, reaming, etc.). Embodiments of the disclosure include estimating and applying the parameter of interest in near real-time. Embodiments may include performing at least one of the following in dependence upon the parameter of interest: i) characterizing a drilling operation in the borehole; ii) optimizing one or more drilling parameters of a drilling operation in the borehole; and iii) optimizing a mud program circulating drilling fluid in the borehole. In particular embodiments, borehole events, state of drilling operations, characteristics of the borehole or formation, or orientation of components of the downhole tool may be estimated using the parameter of interest, and then used in performing one of the operations above. For example, in response to a change in the average size of the downhole cuttings, a different bit configuration may be chosen for a variable drillbit; in response to an estimate of an average size of the downhole cuttings above a threshold level, caving may be predicted and corrective measures may be taken; and so on.

Due to eccentricity of the BHA in the borehole, geosteering, azimuthally varying lithological characteristics of the borehole, or a variety of other factors, action of the drillbit against the formation may be azimuthally dependent. Aspects of the present disclosure comprise using the at least one sensor to produce corresponding information from each of a plurality of azimuthally distributed orientations about a BHA; and using at least one processor to estimate from the information from each of the orientations an azimuthal variation of the parameter of interest relating to the downhole cuttings. The at least one sensor may also be used to estimate the change in azimuthal variation over time. Further operations in the borehole may also be performed in dependence upon the estimated azimuthal variation of the parameter of interest, the time-dependent estimated azimuthal variation of the parameter of interest, or the change over time of the estimated azimuthal variation of the parameter of interest. A change in azimuthal distribution of downhole cuttings may be used to optimize one or more drilling parameters. For example, a change in azimuthal distribution of downhole cuttings may be used to detect a downhole event, such as, for example, stick-slip or the like.

FIG. 1 is a schematic diagram of an exemplary drilling system 100 according to one embodiment of the disclosure. FIG. 1 shows a drill string 120 that includes a bottomhole assembly (BHA) 190 conveyed in a borehole 126. The drilling system 100 includes a conventional derrick 111 erected on a platform or floor 112 which supports a rotary table 114 that is rotated by a prime mover, such as an electric motor (not shown), at a desired rotational speed. A tubing (such as jointed drill pipe 122), having the drilling assembly 190, attached at its bottom end extends from the surface to the bottom 151 of the borehole 126. A drill bit 150, attached to drilling assembly 190, disintegrates the geological formations when it is rotated to drill the borehole 126. The drill string 120 is coupled to a drawworks 130 via a Kelly joint 121, swivel 128 and line 129 through a pulley. Drawworks 130 is operated to control the weight on bit ("WOB"). The drill string 120 may be rotated by a top drive (not shown) instead of by the prime mover and the rotary table 114. Alternatively, a coiled-tubing may be used as the tubing 122. A tubing injector 114*a* may be used to convey the coiled-tubing having the drilling assembly attached to its bottom end. The operations of the drawworks 130 and the tubing injector 114*a* are known in the art and are thus not described in detail herein.

A suitable drilling fluid 131 (also referred to as the "mud") from a source 132 thereof, such as a mud pit, is circulated under pressure through the drill string 120 by a mud pump 134. The drilling fluid 131 passes from the mud pump 134 into the drill string 120 via a desurger 136 and the fluid line 138. The drilling fluid 131*a* from the drilling tubular discharges at the borehole bottom 151 through openings in the drill bit 150. The returning drilling fluid 131*b* circulates uphole through the annular space 127 between the drill string 120 and the borehole 126 and returns to the mud pit 132 via a return line 135 and drill cutting screen 185 that removes the drill cuttings 186 from the returning drilling fluid 131*b*. A sensor S1 in line 138 provides information about the fluid flow rate. A surface torque sensor S2 and a sensor S3 associated with the drill string 120 respectively provide information about the torque and the rotational speed of the drill string 120. Tubing injection speed is determined from the sensor S5, while the sensor S6 provides the hook load of the drill string 120.

Well control system 147 is placed at the top end of the borehole 126. The well control system 147 includes a surface blow-out-preventer (BOP) stack 115 and a surface choke 149 in communication with a wellbore annulus 127. The surface choke 149 can control the flow of fluid out of the borehole 126 to provide a back pressure as needed to control the well.

In some applications, the drill bit 150 is rotated by only rotating the drill pipe 122. However, in many other applications, a downhole motor 155 (mud motor) disposed in the BHA 190 also rotates the drill bit 150. The rate of penetration (ROP) for a given BHA largely depends on the WOB or the thrust force on the drill bit 150 and its rotational speed.

A surface control unit or controller 140 receives signals from the downhole sensors and devices via a sensor 143 placed in the fluid line 138 and signals from sensors S1-S6 and other sensors used in the system 100 and processes such signals according to programmed instructions provided to the surface control unit 140. The surface control unit 140 displays desired drilling parameters and other information on a display/monitor 141 that is utilized by an operator to control the drilling operations. The surface control unit 140 may be a computer-based unit that may include a processor 142 (such as a microprocessor), a storage device 144, such as a solid-state memory, tape or hard disc, and one or more computer programs 146 in the storage device 144 that are accessible to the processor 142 for executing instructions contained in such programs. The surface control unit 140 may further communicate with a remote control unit 148. The surface control unit 140 may process data relating to the drilling operations, data from the sensors and devices on the surface, data received from downhole, and may control one or more operations of the downhole and surface devices. The data may be transmitted in analog or digital form.

The BHA 190 may also contain formation evaluation sensors or devices (also referred to as measurement-while-drilling ("MWD") or logging-while-drilling ("LWD") sensors) determining resistivity, density, porosity, permeability, acoustic properties, nuclear-magnetic resonance properties, formation pressures, properties or characteristics of the fluids downhole and other desired properties of the formation 195 surrounding the BHA 190. Such sensors are generally known in the art and for convenience are generally denoted herein by numeral 165. The BHA 190 may further include a variety of other sensors and devices 159 for determining one or more properties of the BHA 190 (such as vibration, bending moment, acceleration, oscillations, whirl, stick-slip, etc.), drilling operating parameters (such as weight-on-bit, fluid flow rate, pressure, temperature, rate of penetration, azimuth, tool face, drill bit rotation, etc.). For convenience, all such sensors are denoted by numeral 159.

Further, BHA 190 may include sensors for determining characteristics of the borehole and/or the orientation of the borehole with respect to the BHA 190 (e.g., caliper sensors). For example, each caliper sensor may be configured to measure a distance, referred to as standoff, from that sensor to the wall of the borehole. These sensors may be electromagnetic, optical, or acoustic. Sensors may rotate with the BHA, or may be decoupled to rotate at a separate rate or be rotationally stabilized for substantially zero rotation. Example acoustic sensors may include, for example, ultrasonic sensors detecting frequencies from 100 to 500 kHz, although in some embodiments the lower limit is 250 kHz. For convenience, such sensors may be denoted by numeral 159 or 165.

The BHA 190 may include a steering apparatus or tool 158 for steering the drill bit 150 along a desired drilling path. In one aspect, the steering apparatus may include a steering unit 160, having a number of force application members 161*a*-161*n*. The force application members may be mounted directly on the drill string, or they may be at least partially integrated into the drilling motor. In another aspect, the force application members may be mounted on a sleeve, which is rotatable about the center axis of the drill string. The force application members may be activated using electro-mechanical, electro-hydraulic or mud-hydraulic actuators. In yet another embodiment the steering apparatus may include a steering unit 158 having a bent sub and a first steering device 158*a* to orient the bent sub in the wellbore and the second steering device 158*b* to maintain the bent sub along a selected drilling direction. The steering unit 158, 160 may include near-bit inclinometers and magnetometers.

The drilling system 100 may include sensors, circuitry and processing software and algorithms for providing information about desired drilling parameters relating to the BHA, drill string, the drill bit and downhole equipment such as a drilling motor, steering unit, thrusters, etc. Many current drilling systems, especially for drilling highly deviated and horizontal wellbores, utilize coiled-tubing for conveying the drilling assembly downhole. In such applications a thruster may be deployed in the drill string 190 to provide the required force on the drill bit.

Exemplary sensors for determining drilling parameters include, but are not limited to drill bit sensors, an RPM sensor, a weight on bit sensor, sensors for measuring mud motor parameters (e.g., mud motor stator temperature, differential pressure across a mud motor, and fluid flow rate through a mud motor), and sensors for measuring acceleration, vibration, whirl, radial displacement, stick-slip, torque, shock, vibration, strain, stress, bending moment, bit bounce, axial thrust, friction, backward rotation, BHA buckling, and radial thrust. Sensors distributed along the drill string can measure physical quantities such as drill string acceleration and strain, internal pressures in the drill string bore, external pressure in the annulus, vibration, temperature, electrical and magnetic field intensities inside the drill string, bore of the drill string, etc. Suitable systems for making dynamic downhole measurements include COPILOT, a downhole measurement system, manufactured by BAKER HUGHES INCORPORATED.

The drilling system 100 can include one or more downhole processors at a suitable location such as 193 on the BHA 190. The processor(s) can be a microprocessor that uses a computer program implemented on a suitable non-transitory computer-readable medium that enables the processor to perform the control and processing. The non-transitory computer-readable medium may include one or more ROMs, EPROMs, EAROMs, EEPROMs, Flash Memories, RAMs, Hard Drives and/or Optical disks. Other equipment such as power and data buses, power supplies, and the like will be apparent to one skilled in the art. In one embodiment, the MWD system utilizes mud pulse telemetry to communicate data from a downhole location to the surface while drilling operations take place. The surface processor 142 can process the surface measured data, along with the data transmitted from the downhole processor, to evaluate formation lithology. While a drill string 120 is shown as a conveyance device for sensors 165, it should be understood that embodiments of the present disclosure may be used in connection with tools conveyed via rigid (e.g. jointed tubular or coiled tubing) as well as non-rigid (e.g. wireline, slickline, e-line, etc.) conveyance systems. The drilling system 100 may include a bottomhole assembly and/or sensors and equipment for implementation of embodiments of the present disclosure on either a drill string or a wireline.

A point of novelty of the system illustrated in FIG. 1 is that the surface processor 142 and/or the downhole processor 193 are configured to perform certain methods (discussed below) that are not in the prior art. Surface processor 142 or downhole processor 193 may be configured to control mud pump 134, drawworks 130, rotary table 114, downhole motor 155, other components of the BHA 190, or other components of the drilling system 100. Surface processor 142 or downhole processor 193 may be configured to control sensors described above and to estimate a parameter of interest according to methods described herein.

Control of these components may be carried out using one or more models using methods described below. For example, surface processor 142 or downhole processor 193 may be configured to modify drilling operations i) autonomously upon triggering conditions, ii) in response to operator commands, or iii) combinations of these. Such modifications may include changing drilling parameters, mud parameters, and so on. Control of these devices, and of the various processes of the drilling system generally, may be carried out in a completely automated fashion or through interaction with personnel via notifications, graphical representations, user interfaces and the like. Additionally or alternatively, surface processor or downhole processor may be configured for the creation of the model. Reference information accessible to the processor may also be used.

In some general embodiments, surface processor 142, downhole processor 193, or other processors (e.g. remote processors) may be configured to use at least one sensor to produce a corresponding signal, responsive to a reflection of an emitted wave, from each of a plurality of azimuthally distributed orientations about a BHA. The sensors may be the sensors described above with respect to reference numbers 159 and 165 for determining characteristics of the borehole and/or the orientation of the borehole with respect to the BHA 190 (e.g., caliper sensors). One of the processors may also be configured to estimate from the information from each of the orientations an azimuthal variation of the parameter of interest relating to the downhole cuttings. One of the processors may also be configured to cause the corresponding emitted wave.

In operation, a portion of the emitted wave reflects from the downhole cuttings proximate the sensor, and the reflection is detected by the sensor. Thus, each sensor produces a response indicative of the downhole cuttings (which are entrained in the downhole fluid in the annulus surrounding the BHA) reflecting the corresponding emitted wave or waves.

Figure 2A:
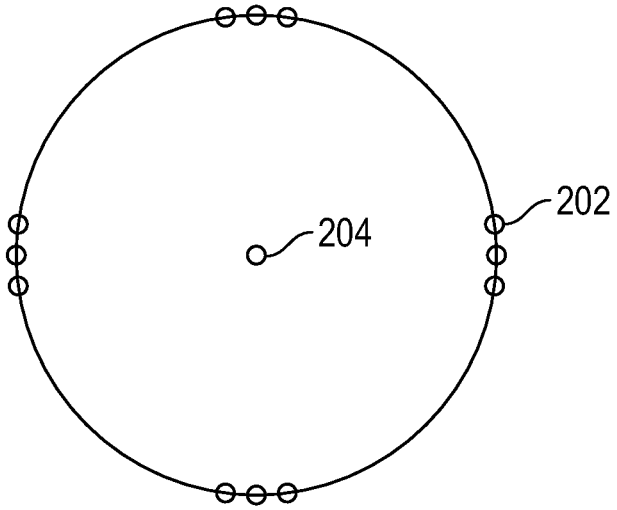
FIGS. 2A and 2B show a cross section of a BHA having a plurality of corresponding azimuthally distributed sensors.
Figure 2B:
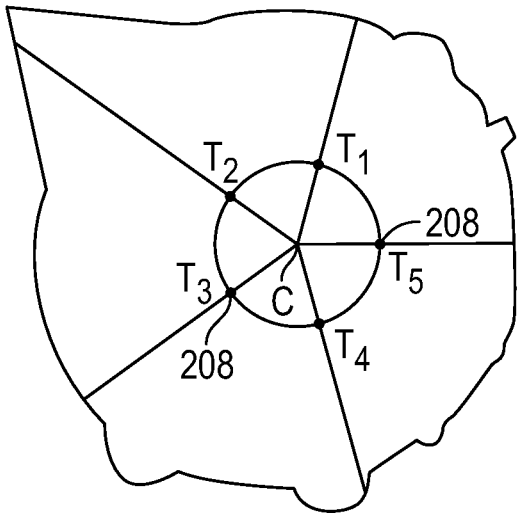

FIGS. 2A and 2B show a cross section of a BHA having a plurality of corresponding azimuthally distributed sensors. In FIG. 2A, the sensors 202 are non-uniformly distributed about a longitudinal axis 204 of the BHA 200. In FIG. 2B, BHA 200 includes five uniformly distributed (e.g. 72° apart) acoustic transducers 208 labeled T1-T5. The sensors may be electromagnetic, optical, or acoustic. Sensors 202 and 208 may be solid-state ultrasonic acoustic transducers. Appropriate sensors may include a highly granular response, such as, for example, capable of response to particles as small as 1 millimeter, 0.1 millimeters, 0.01 millimeters, or smaller, taking up a volume of less than 1 percent of the fluid interval of the borehole surrounding the BHA. In particular embodiments, the transducers may be configured to emit an acoustic wave and receive a reflection of the wave. Other embodiments may include additional transducers or other devices for producing the emitted waves.

The system may be configured, using a processor and sensor circuitry operatively coupled to sensors 202,208 (or alternatively, to additional transducers), to emit waves. The waves may be acoustic, optical (e.g. laser), or electromagnetic (e.g. RADAR). The system may be configured to emit waves at multiple frequencies (e.g., combined frequencies, performing a frequency sweep, etc.) to provide a variation in response from downhole fluid with a cuttings content having a wide array of characteristics. Resolution may be increased (e.g., smaller cuttings particles detected) by using waves having shorter wavelengths. However, the specific frequencies or range of frequencies used may be selected in dependence upon expected characteristics of the downhole cuttings (e.g. particle size, particle density, etc.), of the borehole (including downhole fluid density), or of the formation. These characteristics may be inferred from historical data or by analogy, or estimated using other techniques known in the art. Use of multiple frequencies may also facilitate estimation of a parameter of interest despite changes in density of the downhole fluid containing the downhole cuttings and changes in distance to the downhole cuttings.

The parameters of interest relating to the characteristics of downhole cuttings reflecting the wave may be estimated using various processing techniques. Some embodiments may include using various algorithms developed to characterize the degree of scatter in the acoustic field. Embodiments of the disclosure may include frequency dependent routines that would allow for condition matching using information from one sensor, a plurality of sensors (e.g., by segments), or all sensors to enable characterization of the downhole cuttings or characterization and classification of the state of the wellbore, e.g. detection of expected events.

Referring to FIG. 2B, some processing techniques may rely on the azimuthal distribution of information. The azimuthal distribution of the sensors provides identifiable differences in response with respect to azimuthal orientation that may be used for the characterization and classification of the wellbore, e.g., event detection. Method embodiments may include defining a cross-section of the borehole as a plurality of sectors and associating the corresponding information from each of the plurality of azimuthally distributed orientations with a corresponding azimuthal window representing at least one of the plurality of sectors.

Some processing techniques may use changes of the information with respect to time for one or more sensors. The information provided by the azimuthally distributed array of sensors would further be able to identify changes in the distribution of cuttings in the mud system proximate the BHA over time to characterize the cutting, circulation and transportation of solids in the mud system. Time-dependent versions of any of the techniques above may be employed to estimate a parameter of interest or characterize the state of the wellbore using time-dependent sensor information.

Figure 3A:
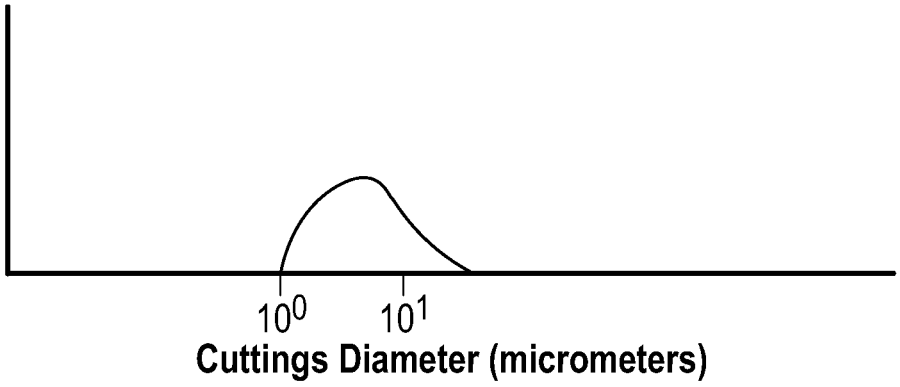
FIGS. 3A and 3B illustrate example standard signal responses of cuttings in accordance with embodiments of the present disclosure.
Figure 3B:
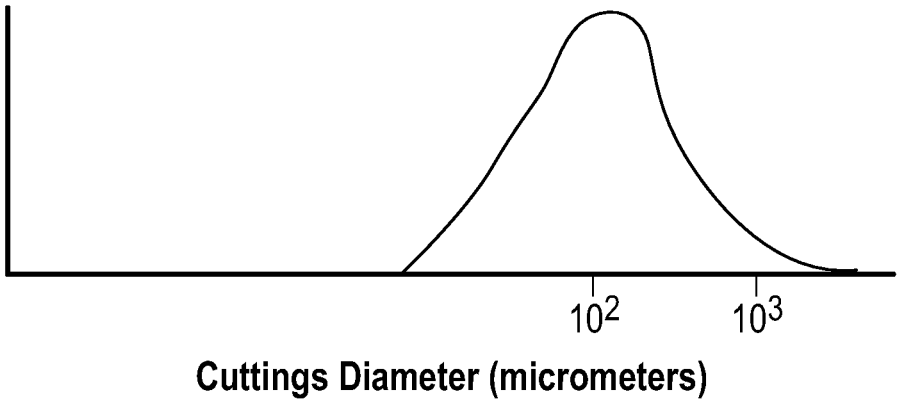
Figure 3C:
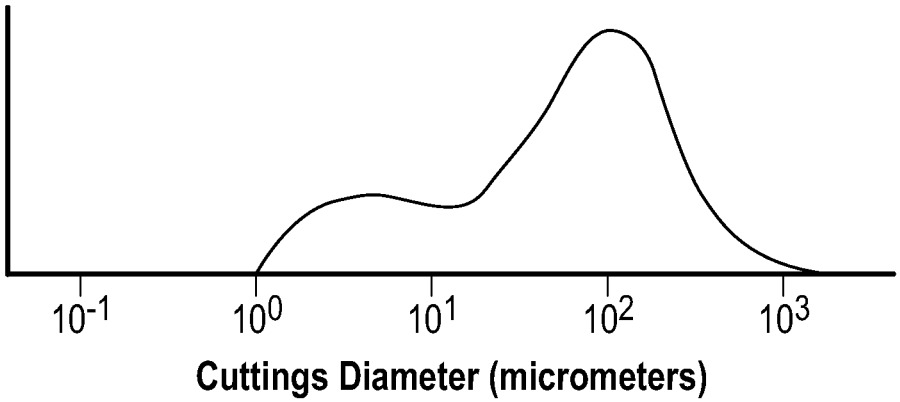
FIG. 3C illustrates an example signal response in accordance with embodiments of the present disclosure.

An accumulation of particles having similar characteristics may have a distinct aggregate signal response. Thus, a number of particles with approximately the same size, shape, chemical and structural composition, or particulate density, or combinations of these, may have a distinct signature. FIG. 3A illustrates an example standard signal response of cuttings of a first characteristic type in accordance with embodiments of the present disclosure. FIG. 3B illustrates an example standard signal response of cuttings of a second characteristic type in accordance with embodiments of the present disclosure. If the measured volume of the borehole for the sensor is filled with cuttings comprised of many types of materials, the signal may be an accumulation of all of their signals. FIG. 3C illustrates an example signal response corresponding to cuttings comprising a mixture of the first characteristic type and the second characteristic type in accordance with embodiments of the present disclosure. Further analysis may be used to represent the signals by a weighted combination of the principal components.

Standard deconvolution methods may be adapted to identify the reference signatures and the fractional distribution for various characteristics. Embodiments may include using a predetermined matrix to estimate from the information a parametric representation of a selection of parameters of interest of downhole cuttings. Defining the predetermined matrix may be done by performing a regression analysis on synthetic signals and/or signals measured on samples having known properties. The regression analysis may be a partial least-squares, a principal component regression, an inverse least-squares, a ridge regression, a Neural Network, a neural net partial least-squares regression, and/or a locally weighted regression. This capability may be integrated with downhole pressure sensors to allow for event characterization and classification.

Returning to FIG. 2B, information from each of the plurality of azimuthally sensors 208 may additionally be used in estimating a standoff of the bottom hole assembly from the borehole with respect to azimuth. Specific frequencies or frequency ranges may be selected for standoff estimation, which may be different than the frequencies or frequency ranges used for cuttings analysis. The sensors 208 are disposed along the circumference of BHA 200. Thus, the measured distance may be adjusted to account for the offset of the sensors from a common reference point, such as, for example, the central longitudinal axis of the BHA (or any other convenient longitudinal axis). Accordingly each sensor 208 may provide output used to determine the distance from the longitudinal axis of BHA 200 to the borehole wall at the nearest point to the respective sensor 208. The sensors 208 may acquire information substantially simultaneously, or at different times. Information from a plurality of sensor taken substantially simultaneously may be referred to as a measurement set, and may associate with one another. Sensors 208 may be uniformly or non-uniformly distributed along the perimeter (e.g., circumference) of BHA 200. The corresponding orientations may also be recorded and associated with the measurement. In embodiments, the orientation is correlated with the direction of the Earth's magnetic field using one or more magnetometers. By measuring two-way transit time (e.g., using downhole processor), a distance from the acoustic transducer to the nearest point of the borehole wall in front the transducer may be measured in dependence upon the acoustic velocity of the downhole fluid in the borehole.

Estimation of the borehole configuration may be obtained by dividing the measured cross-section of the borehole into a plurality of sectors. Statistical analysis on the distribution of standoff (radius) values captured may be performed for each sector to determine a representative radius for the sector. The representative radius may represent a radius in the range of radii having the highest measurement density. The representative radius may be obtained using a variety of algorithms. Adjacent representative radius points may then be connected to obtain a closed curve. Further processing of this curve and/or the information from the sensors may be used to refine the estimated borehole geometry.

Figure 4:
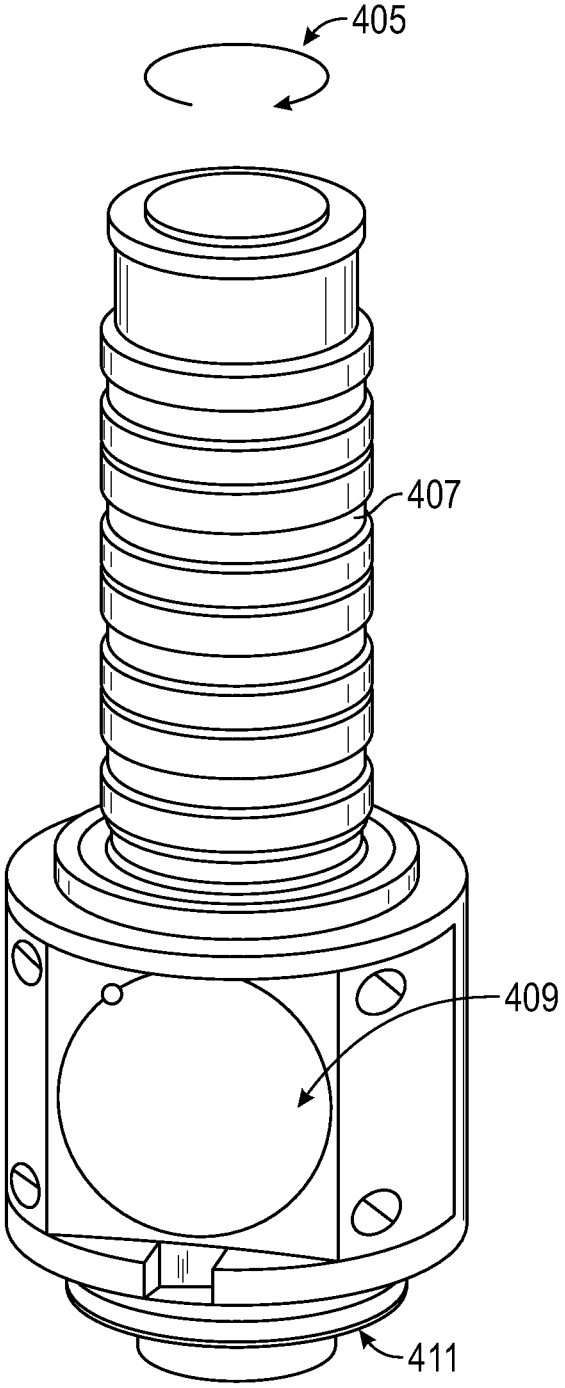
FIG. 4 illustrates another sensor in accordance with embodiments of the present disclosure.

FIG. 4 illustrates another sensor in accordance with embodiments of the present disclosure. The sensor comprises a rotating platform 405 with an ultrasonic transducer assembly 409. The rotating platform is also provided with a magnetometer 411 to make measurements of the orientation of the platform and the ultrasonic transducer. The platform is provided with coils 407 that are the secondary coils of a transformer that are used for communicating information from the transducer and the magnetometer to the non-rotating part of the tool. The transducer may be made of a composite material. In operation, the transducer may be made to rotate about the longitudinal axis of the BHA, and to receive at each of the plurality of azimuthally distributed orientations the reflection of the corresponding emitted wave and produce the corresponding information. In other embodiments, a multi-directional acoustic sensor may be used. The multi-directional acoustic sensor may be configured for beamforming to receive from each of a plurality of azimuthally distributed orientations the reflection of the corresponding emitted wave. The sensor may then produce corresponding information associated with each orientation.

Figure 5:
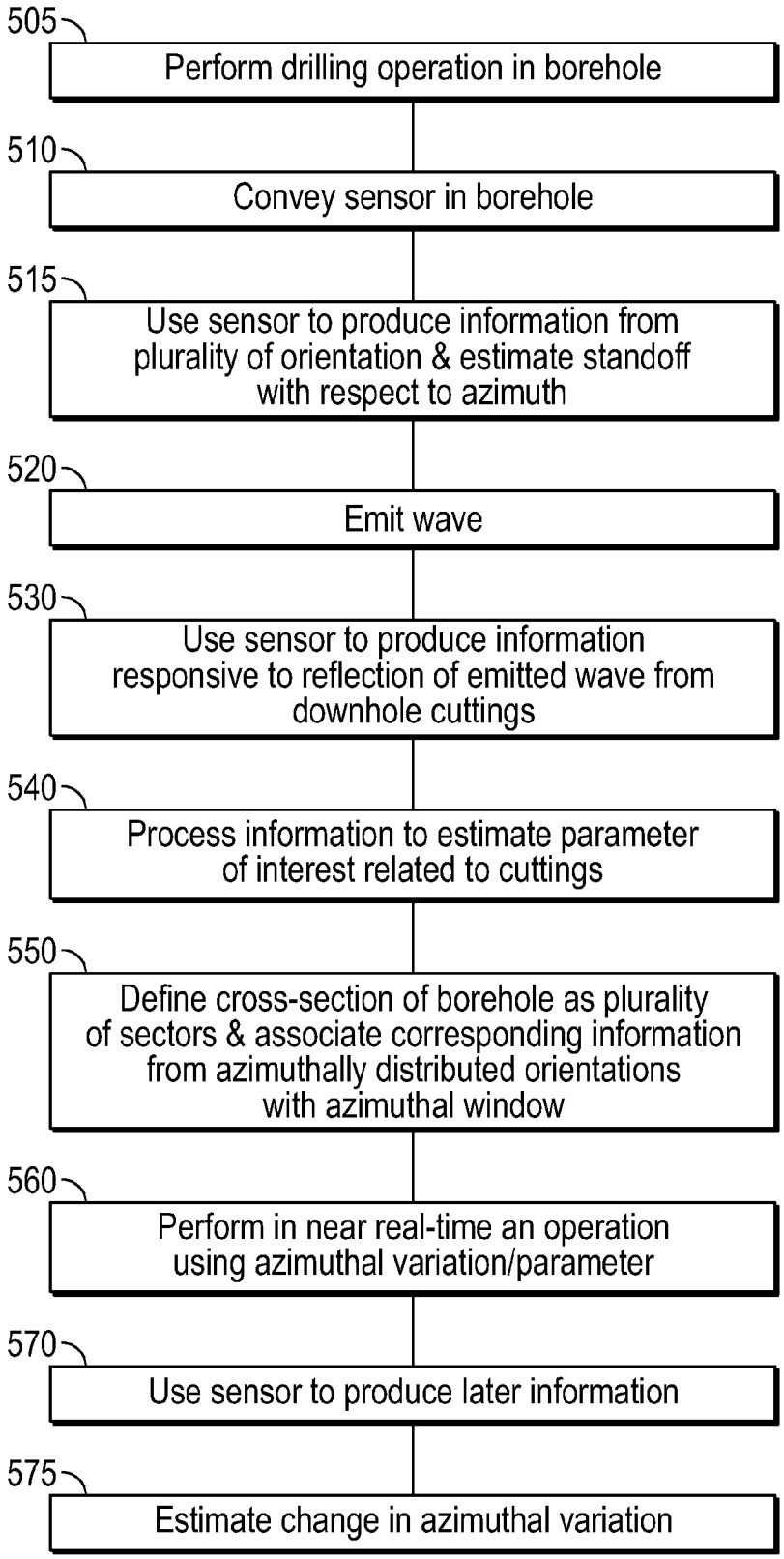
FIG. 5 illustrates a method for evaluating downhole cuttings entrained in a downhole fluid in a borehole intersecting an earth formation.

FIG. 5 illustrates a method for evaluating downhole cuttings entrained in a downhole fluid in a borehole intersecting an earth formation. Optional step 505 of the method 500 may include performing a drilling operation in a borehole. For example, a drill string may be used to form (e.g., drill) the borehole. Optional step 510 may include conveying at least one acoustic sensor in the borehole on a conveyance device.

Optional step 520 of the method 500 may include emitting a wave. In some embodiments, step 520 may include emitting a wave toward each of a plurality of azimuthally distributed orientations about a bottom hole assembly (BHA). For example, the emitted wave may be electromagnetic, optical, or acoustic. Step 530 of the method 500 may include using at least one sensor to produce information responsive to a reflection of an emitted wave from downhole cuttings in the borehole, wherein the information is indicative of a parameter of interest relating to the downhole cuttings. For convenience of discussion, the wave will be referred to as an acoustic wave. The parameter of interest may be average particle size of the downhole cuttings; distribution of particle sizes; quantitative indicator of shape of the downhole cuttings; volume of the downhole cuttings; and cuttings hold-up. Step 530 may include using the at least one acoustic sensor to produce corresponding information from each of a plurality of azimuthally distributed orientations about a bottom hole assembly.

Optionally, at step 530, the method may be carried out by using a transducer rotating about a substantially longitudinal axis of the BHA to receive at each of the plurality of azimuthally distributed orientations the reflection of the corresponding emitted wave and produce the corresponding information. Step 530 may further be carried out by rotating the transducer with respect to the BHA. As another option, step 530 may be carried out by using a multi-directional acoustic sensor configured for beamforming to receive from each of the plurality of azimuthally distributed orientations the reflection of the corresponding emitted wave.

Alternatively, step 530 may be carried out by producing the corresponding information from each of the plurality of azimuthally distributed orientations using each of a plurality of corresponding azimuthally distributed acoustic sensors.

Step 540 may include processing the information using at least one processor to estimate the parameter of interest. Step 550 may further include using the at least one processor to estimate from the information from each of the orientations an azimuthal variation of the parameter of interest relating to the downhole cuttings. Step 550 may be carried out by defining a cross-section of the borehole as a plurality of sectors; and associating the corresponding information from each of the plurality of azimuthally distributed orientations with a corresponding azimuthal window representing at least one of the plurality of sectors.

Optional step 560 may include using the parameter of interest or the estimated azimuthal variation to perform in near real-time at least one of: i) characterizing a drilling operation; ii) optimizing one or more drilling parameters of a drilling operation; and iii) optimizing a mud program. Mathematical models, look-up tables, neural networks, or other models representing relationships between the parameter(s) of interest and drilling parameters, mud program parameters, formation characteristics, borehole events, and the like may be used to characterize the drilling operation, optimize one or more drilling parameters of a drilling operation or optimize a mud program. The system may carry out these actions through notifications, advice, and/or intelligent control.

For example, a sudden lack of cuttings may indicate that a kick is imminent. In response, mud weight may be increased. In response to cuttings hold-up exceeding a threshold level, a circulation rate may be increased. Some steps may be performed together, or by the same actions. A plurality of criteria may be combined, such as, for example, cuttings hold-up, change in the number of particles over time, azimuthal distribution of hold-up, and so on. For example, a sudden increase in total volume of downhole cuttings in a sector wherein the cuttings size distribution is significantly higher than typical for a particular bit may be characterized as caving. The information may reflect that the instantaneous cuttings hold-up for sector 4 is 80 percent higher than the next highest sector, indicating that the caving is proximate that sector of the BHA.

Further method embodiments may include designating sensor information received during nominal operation of the BHA as nominal operating sensor information. Nominal operation may be confirmed by other sensors and diagnostic processes, either contemporaneously or at a later time. Event detection may include detecting information deviating from the nominal operating sensor information, e.g., by a threshold amount or a statistically significant amount. In one example, one or more statistical operations may be performed on sensor information in near real-time to detect significant deviation. A weighted or non-weighted moving average of a parameter of interest, or of raw or processed signal data (e.g., amplitude, frequency), may be determined and analyzed using statistical analyses such as variance, standard deviation, t-distribution, confidence interval and the like to determine if the change over time of the parameter or signal is statistically significant. An event detection may be triggered upon detecting significant deviation. For example, if the current value lies outside a standard deviation for the previous 10 measurements or exceeds a preselected threshold percentage change from the moving average, this may indicate a significant deviation. In response, a notification or alert may be triggered and/or additional diagnostic measures may be taken.

Optional step 570 may occur at one or more second times (which may be later than one or more first times during which step 530 occurs) and may include using the at least one acoustic sensor to produce later corresponding information from each of a plurality of azimuthally distributed orientations. Optional step 575 may include estimating from the corresponding information and the later corresponding information a change in azimuthal variation of the parameter of interest over time; and using the estimated change in azimuthal variation of the parameter of interest over time to perform in near real-time (with respect to the one or more second times) at least one of: i) characterizing a drilling operation; ii) optimizing one or more drilling parameters of a drilling operation; and iii) optimizing a mud program.

Optional step 515 may occur at one or more third, earlier, times, and may include using the at least one acoustic sensor to produce earlier corresponding information from each of the plurality of azimuthally distributed orientations at one or more third times. Optional step 515 may include estimating from the earlier corresponding information from each of the plurality of azimuthally distributed orientations a standoff of the bottom hole assembly from the borehole with respect to azimuth. For the corresponding information at the one or more first times, the emitted acoustic wave may be at one or more first frequencies. For the corresponding information at the one or more third times, the emitted wave may be at one or more second frequencies different than the one or more first frequencies.

The term "downhole cuttings" refers to drill cuttings or other downhole debris entrained in downhole fluid ranging from a size of less than 0.01 millimeters to several millimeters. "The term "conveyance device" or "carrier" as used above means any device, device component, combination of devices, media and/or member that may be used to convey, house, support or otherwise facilitate the use of another device, device component, combination of devices, media and/or member. Exemplary non-limiting conveyance devices include drill strings of the coiled tube type, of the jointed pipe type and any combination or portion thereof. Other conveyance device examples include casing pipes, wirelines, wire line sondes, slickline sondes, drop shots, downhole subs, BHA's, drill string inserts, modules, internal housings and substrate portions thereof, and self-propelled tractors.

The term "information" as used herein includes any form of information (analog, digital, EM, printed, etc.). As used herein, a processor is any information processing device that transmits, receives, manipulates, converts, calculates, modulates, transposes, carries, stores, or otherwise utilizes information. In several non-limiting aspects of the disclosure, an information processing device includes a computer that executes programmed instructions for performing various methods. These instructions may provide for equipment operation, control, data collection and analysis and other functions in addition to the functions described in this disclosure. The processor may execute instructions stored in computer memory accessible to the processor, or may employ logic implemented as field-programmable gate arrays ('FPGAs'), application-specific integrated circuits ('ASICs'), other combinatorial or sequential logic hardware, and so on.

An information processing device may include a processor, resident memory, and peripherals for executing programmed instructions. In some embodiments, estimation of the parameter of interest may involve applying a model. The model may include, but is not limited to, (i) a mathematical equation, (ii) an algorithm, (iii) a database of associated parameters, (iv) an array, or a combination thereof which describes physical characteristics of the downhole cuttings in relation to information received by the sensors described herein.

The term "in-situ" as applied herein to evaluation of downhole cuttings refers to evaluation of cuttings in the vicinity of the BHA prior to exposure to external influences, e.g., as they are created in the borehole, and may be defined as, downhole cuttings the majority portion of which have been cut within the previous 100 seconds, 60 seconds, 30 seconds, 15 seconds, and so on; downhole cuttings analyzed along the length of the BHA; and downhole cuttings around the BHA entrained in fluid in an interval of the annulus between the borehole and the BHA. The phrase, "in the vicinity of the BHA" refers to a distance of up to 30 feet from the BHA.

The term "near real-time" as applied to estimation of downhole cuttings described herein refers to estimation of the parameter of interest of the downhole cuttings while the BHA is still downhole and prior to the drill bit extending the borehole a distance of 1 meter, 0.5 meters, 0.25 meters, 0.1 meters, or less; and may be defined as estimation of the parameter of interest of the downhole cuttings within 15 minutes of the creation of the downhole cuttings, within 10 minutes of the creation of the downhole cuttings, within 5 minutes of the creation of the downhole cuttings, within 3 minutes of the creation of the downhole cuttings, within 2 minutes of the creation of the downhole cuttings, within 1 minute of the creation of the downhole cuttings, or less.

The term "azimuthal distribution" refers to distribution over three or more points about a center, wherein any two consecutive points are less than 180 degrees apart. The term "substantially longitudinal axis" as applied to the rotational axis of a rotating transducers means an axis sufficiently close to a longitudinal axis of the BHA to receive at each of the plurality of azimuthally distributed orientations a reflection of a corresponding emitted wave from cuttings adjacent the BHA.

The term "cuttings hold-up" as used herein means a fraction of an annular fluid interval between the borehole and the BHA occupied by downhole cuttings. The term "fluid interval" as used herein means a volume through which downhole fluids may freely flow. As used herein, the term "fluid" and "fluids" refers to one or more gasses, one or more liquids, and mixtures thereof. A "downhole fluid" as used herein includes any gas, liquid, flowable solid and other materials having a fluid property, and relating to hydrocarbon recovery. A downhole fluid may be natural or man-made and may be transported downhole or may be recovered from a downhole location. Non-limiting examples of downhole fluids include drilling fluids, return fluids, formation fluids, production fluids containing one or more hydrocarbons, oils and solvents used in conjunction with downhole tools, water, brine, and combinations thereof.

While the present disclosure is discussed in the context of a hydrocarbon producing well, it should be understood that the present disclosure may be used in any borehole environment (e.g., a water or geothermal well).

The present disclosure is susceptible to embodiments of different forms. There are shown in the drawings, and herein are described in detail, specific embodiments of the present disclosure with the understanding that the present disclosure is to be considered an exemplification of the principles of the disclosure and is not intended to limit the disclosure to that illustrated and described herein. While the foregoing disclosure is directed to the one mode embodiments of the disclosure, various modifications will be apparent to those skilled in the art. It is intended that all variations be embraced by the foregoing disclosure.

We claim:

1. A method of evaluating downhole cuttings entrained in a downhole fluid in a borehole intersecting an earth formation, the method comprising:

conveying at least one acoustic sensor in the borehole on a drill string;

performing a drilling operation which produces downhole cuttings from disintegration of the formation;

using the at least one acoustic sensor to produce information responsive to a reflection of an emitted acoustic wave from the downhole cuttings in the borehole, wherein the information is indicative of a parameter of interest relating to the downhole cuttings;

processing the information using at least one processor to estimate the parameter of interest, wherein the parameter of interest comprises at least one of: i) average particle size of the downhole cuttings; ii) distribution of particle sizes; iii) quantitative indicator of shape of the downhole cuttings; and using the parameter of interest in performing further operations comprising at least one of:

i) characterizing the drilling operation;

ii) optimizing one or more drilling parameters of the drilling operation; and iii) optimizing a mud program for the drilling operation.

2. The method of claim 1 further comprising performing the further operations using the parameter of interest in near real-time.

3. The method of claim 1 wherein:

using the at least one acoustic sensor to produce the information further comprises using the at least one acoustic sensor to produce corresponding information from each of a plurality of azimuthally distributed orientations about a bottom hole assembly (BHA); and processing the information further comprises using the at least one processor to estimate from the information from each of the orientations an azimuthal variation of the parameter of interest relating to the downhole cuttings.

4. The method of claim 3 further comprising using a transducer rotating about a substantially longitudinal axis of the BHA to receive at each of the plurality of azimuthally distributed orientations the reflection of the corresponding emitted wave and produce the corresponding information.

5. The method of claim 4 further comprising rotating the transducer with respect to the BHA.

6. The method of claim 3 further comprising producing the corresponding information from each of the plurality of azimuthally distributed orientations using each of a plurality of corresponding azimuthally distributed acoustic sensors.

7. The method of claim 6 further comprising:

defining a cross-section of the borehole as a plurality of sectors; and associating the corresponding information from each of the plurality of azimuthally distributed orientations with a corresponding azimuthal window representing at least one of the plurality of sectors.

8. The method of claim 3 further comprising using a multi-directional acoustic sensor configured for beamforming to receive from each of the plurality of azimuthally distributed orientations the reflection of the corresponding emitted wave and produce the corresponding information.

9. The method of claim 3 further comprising using the estimated azimuthal variation to perform in near real-time at least one of:

i) characterizing a drilling operation;

ii) optimizing one or more drilling parameters of a drilling operation; and iii) optimizing a mud program.

10. The method of claim 3, further comprising:

using the at least one acoustic sensor to produce the corresponding information from each of a plurality of azimuthally distributed orientations at one or more first times;

using the at least one acoustic sensor to produce later corresponding information from each of a plurality of azimuthally distributed orientations at one or more second times; and estimating from the corresponding information and the later corresponding information a change in azimuthal variation of the parameter of interest over time; and using the estimated change in azimuthal variation of the parameter of interest over time to perform in near real-time, with respect to the one or more second times, at least one of:

i) characterizing a drilling operation;

ii) optimizing one or more drilling parameters of a drilling operation; and iii) optimizing a mud program.

11. The method of claim 3, further comprising:

using the at least one acoustic sensor to produce the corresponding information from each of the plurality of azimuthally distributed orientations at one or more first times;

using the at least one acoustic sensor to produce earlier corresponding information from each of the plurality of azimuthally distributed orientations at one or more third times; and estimating from the earlier corresponding information from each of the plurality of azimuthally distributed orientations a standoff of the bottom hole assembly from the borehole with respect to azimuth.

12. The method of claim 11 wherein, for the corresponding information at the one or more first times the emitted acoustic wave is at one or more first frequencies, and for the corresponding information at the one or more third times, the emitted wave is at one or more second frequencies different than the one or more first frequencies.

13. An apparatus for evaluating cuttings entrained in a downhole fluid in a borehole intersecting an earth formation, the apparatus comprising:

a drill string configured to perform a drilling operation which produces downhole cuttings from disintegration of the formation by the drill string;

at least one acoustic sensor on the drill string, the at least one acoustic sensor configured to produce information responsive to a reflection of an emitted acoustic wave from the downhole cuttings in the borehole, wherein the information is indicative of a parameter of interest relating to the downhole cuttings; and at least one processor configured to estimate the parameter of interest using the information, wherein the parameter of interest comprises at least one of: i) average particle size of the downhole cuttings; ii) distribution of particle sizes; iii) quantitative indicator of shape of the downhole cuttings.

14. The apparatus of claim 13 wherein:

the at least one acoustic sensor is configured to produce corresponding information from each of a plurality of azimuthally distributed orientations about the BHA; and the at least one processor is configured to estimate from the corresponding information from each of the orientations an azimuthal variation of the parameter of interest relating to the downhole cuttings.

15. The apparatus of claim 14 wherein the at least one acoustic sensor comprises a plurality of azimuthally distributed acoustic sensors producing the corresponding information from each of the plurality of azimuthally distributed orientations.

16. An apparatus for evaluating cuttings entrained in a downhole fluid in a borehole intersecting an earth formation, the apparatus comprising:

a bottom hole assembly (BHA) on a drill string configured for conveyance into the borehole for performing a drilling operation which produces downhole cuttings from disintegration of the formation by the drill string;

a plurality of sensors azimuthally distributed in the BHA, each of the sensors configured to produce information responsive to the downhole cuttings in the borehole, wherein the information is indicative of a parameter of interest relating to the downhole cuttings;

at least one processor configured to estimate from the information from each of the sensors an azimuthal variation of the parameter of interest relating to the cuttings, wherein the parameter of interest comprises at least one of: i) average particle size of the downhole cuttings; ii) distribution of particle sizes; iii) quantitative indicator of shape of the downhole cuttings.

17. The apparatus of claim 16, wherein the plurality of sensors comprises a plurality of acoustic sensors.

18. The apparatus of claim 16, wherein the plurality of sensors comprises a plurality of electromagnetic sensors.

19. The apparatus of claim 16, wherein the plurality of sensors comprises a plurality of optical sensors.

* * * * *